US009770387B2

(12) United States Patent
McCormack

(10) Patent No.: US 9,770,387 B2
(45) Date of Patent: Sep. 26, 2017

(54) ELECTRIC SAUNA HEATER WITH EVAPORATOR PLATES

(71) Applicant: Sauna and Steam Distributors Ltd, Abbeyfeale (IE)

(72) Inventor: Vincent McCormack, Newcastle West (IE)

(73) Assignee: SAUNA AND STEAM DISTRIBUTORS LTD, Abbeyfeale (IE)

( * ) Notice: Subject to any disclaimer, the term of this patent is extended or adjusted under 35 U.S.C. 154(b) by 0 days.

(21) Appl. No.: 14/915,645

(22) PCT Filed: Sep. 18, 2014

(86) PCT No.: PCT/GB2014/052853

§ 371 (c)(1),
(2) Date: Mar. 1, 2016

(87) PCT Pub. No.: WO2015/040412

PCT Pub. Date: Mar. 26, 2015

(65) Prior Publication Data

US 2016/0235624 A1 Aug. 18, 2016

(30) Foreign Application Priority Data

Sep. 18, 2013 (GB) ..... 1316603.8

(51) Int. Cl.

| | |
|---|---|
| ***F24F 6/08*** | (2006.01) |
| ***A61H 33/06*** | (2006.01) |
| ***A61H 33/00*** | (2006.01) |
| ***B01F 3/04*** | (2006.01) |

(52) U.S. Cl.

CPC ..... *A61H 33/6005* (2013.01); *A61H 33/06* (2013.01); *A61H 33/063* (2013.01); *A61H 33/065* (2013.01); *B01F 3/04* (2013.01); *F24F 6/08* (2013.01)

(58) Field of Classification Search

CPC ... B01F 3/04; F24F 6/08; A61H 33/06; A61H 33/063

USPC ..... 126/344

See application file for complete search history.

(56) References Cited

U.S. PATENT DOCUMENTS 3,372,264 A * 3/1968 Williams ..... A61H 33/063 126/344

3,400,248 A * 9/1968 Isomaa ..... A61H 33/063 126/344

FOREIGN PATENT DOCUMENTS

WO WO 9635316 A1 * 11/1996 ..... A61H 33/063

* cited by examiner

*Primary Examiner* — Robert A Hopkins

(57) ABSTRACT

Evaporator tray (100) for a sauna heater has one or more elongate plate members (102) extending across a support member (104). Support member (104) has at least two sides. In use, plate members (102) support rocks (not shown). Plate members (102) have a generally concave or hollow cross-section with a hollow face (106) upturned, which means they can collect unevaporated water, thereby protecting the sauna heater. The generally concave shape may be "V"-shaped, "U"-shaped, arcuate or concave, or any shape suitable for retaining water.

4 Claims, 2 Drawing Sheets

ELECTRIC SAUNA HEATER WITH EVAPORATOR PLATES

TECHNICAL FIELD

The present invention relates to heaters used in saunas, and in particular to trays for supporting rocks or coals.

BACKGROUND ART

There are many designs of electrical sauna heaters that use heating elements. GB645279A discloses a sauna heater that is heated by a fire as which means that the heating plate comprised of three concentrically arranged annular pieces and a disc shaped piece must withstand flames and smoke. There is no disclosure of passage of air from the heat chamber to the rocks.

The majority of designs comprise several electrical heating elements with sauna rocks placed on top of or in around the elements. The contact between the rocks and the elements cause damage to both components and they quickly deteriorate. Common practice amongst sauna users is the pouring of water onto the rocks. This is done to increase the apparent heat in the sauna cabin by raising the humidity. Pouring water onto the rocks and elements adds to the rate of deterioration. In many of these designs, it is only the rocks that protect the user from direct contact with the heating elements and as the rocks break down from use the elements become exposed causing a hazard to safety. For example, although DE2300293A1 discloses a series of air outlet openings for hot air provided at the upper edge of an inner lateral boundary of tray holding coals. this would allow the admittance of water.

In some designs the issue of safety has been addressed by placing protective shields over the elements. This has the effect of reducing the heat being transferred to the rocks. It then becomes difficult to raise the humidity of the sauna cabin.

JP2010142374A discloses a relatively complex environment within the heater body having a series of trays between a heater and a perforated plate. The hottest place within the heater will be just above the heater elements, and the coolest place within the heater will be directly below the perforated plate. In this disclosure there is a considerable distance between the two. As the perforated plate is constantly being cooled by the pouring on of water, the water that is not evaporated enters through the perforated plate into the environment of the heater housing and is retained there in the channels that are attached to the inside of the heater shell. The water will evaporate to increase the humidity within the heater shell. 100% humidity is likely in this environment. At 100% humidity a dew point of 100 deg C. is possible. Since the perforated plate is being constantly cooled by water the temperature of the plate is like to be 100 C. therefore condensation could occur on the underside of the plate and drip back down into the trays. This will prevent the heating of the rocks and cause poor air circulation. Poor air circulation will also have an adverse effect on the heating elements. Also the proposed perforated tray will not provide sufficient air passage.

The present invention addresses these issues, improving operating and maintenance issues associated with electric sauna heaters, and improving safety in use. In particular, the present invention avoids problems associated with a build-up of humidity within the apparatus.

DISCLOSURE OF INVENTION

According to a first embodiment, the present invention provides an evaporator tray for a sauna heater, which comprises a support member and one or more elongate plate members extending across said support member. The plate members comprise a concave cross-section, which means that in use, the plate members support rocks and collect unevaporated water, which protects the sauna heater.

Preferably, the generally concave cross-section includes a cross-section which is "V"-shaped, "U"-shaped, arcuate, concave, or other shape suitable for collecting water.

Preferably, the elongate plate members form two layers extending across said support members, one layer arranged above the other in use. Preferably, the elongate plate members are horizontally staggered to allow passage of hot air from a heating element located in said sauna heater.

Preferably, the evaporator tray includes a housing for retaining the rocks.

According to a further aspect, the present invention provides a sauna heater comprising the evaporator tray described above.

BRIEF DESCRIPTION OF DRAWINGS

For a more complete explanation of the present invention and the technical advantages thereof, reference is now made to the following description and the accompanying drawings in which.

MODES FOR CARRYING OUT THE INVENTION

Figure 1:
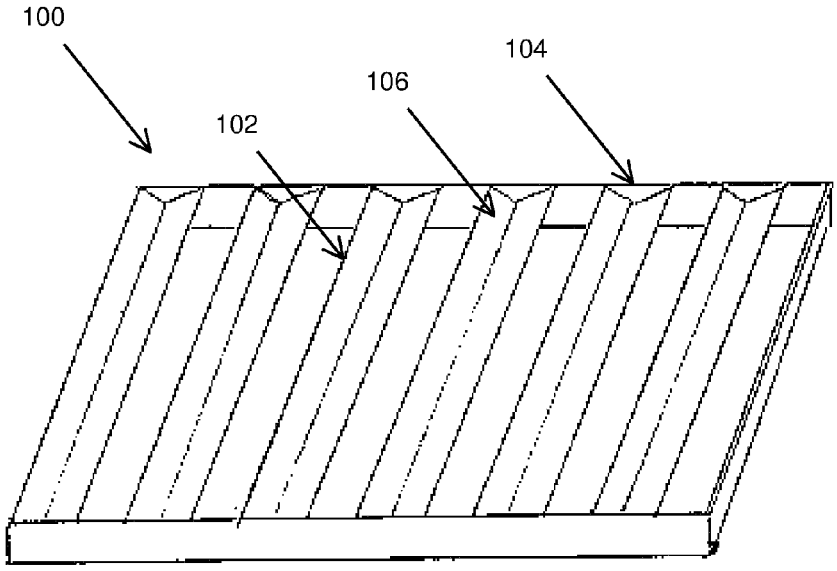
FIG. 1 shows an evaporator tray for a sauna heater.

Referring now to FIG. 1, which shows an evaporator tray 100 for a sauna heater (not shown), one or more elongate plate members 102 extend across a support member 104. Support member 104 has at least two sides. In use, plate members 102 support rocks (not shown). Plate members 102 have a generally concave or hollow cross-section with a hollow face 106 upturned, which means they can collect unevaporated water, thereby protecting the sauna heater. The generally concave shape may be "V"-shaped, "U"-shaped, arcuate or concave, or any shape suitable for retaining water.

Figure 2:
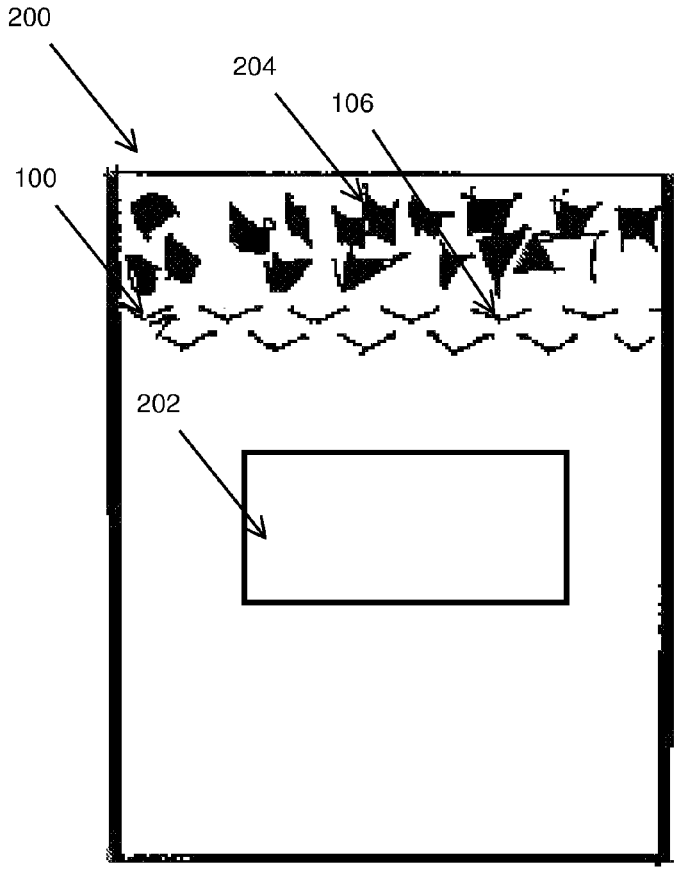
FIG. 2 shows a sectional view of a sauna heater having the evaporator tray.

Referring now to FIG. 2, which shows a sectional view of a sauna heater 200, evaporator trays 100 are placed overhead and in close proximity to heating elements 202. Sauna rocks 204 are placed on top of plate members 102. Typically there are two layers of plate members 102, one layer arranged above the other in use and which are horizontally staggered to allow passage of hot air from heating elements 202 to rocks 204. Hot air from heating elements 202 heats plate members 102 and rocks 204 to a high temperature.

When water is poured onto rocks 204, it is first evaporated by the heated rocks. When rocks 204 are no longer hot enough to evaporate the water, it travels through onto plate members 102. The top layer of plate members 102 are hotter than rocks 204 and have a high capacity to evaporate the water. When the top layer of plate members 102 have cooled the water travels through to the next layer of plate members 102, which are even hotter and have an even higher capacity to evaporate the water being poured onto the heater.

Figure 3:
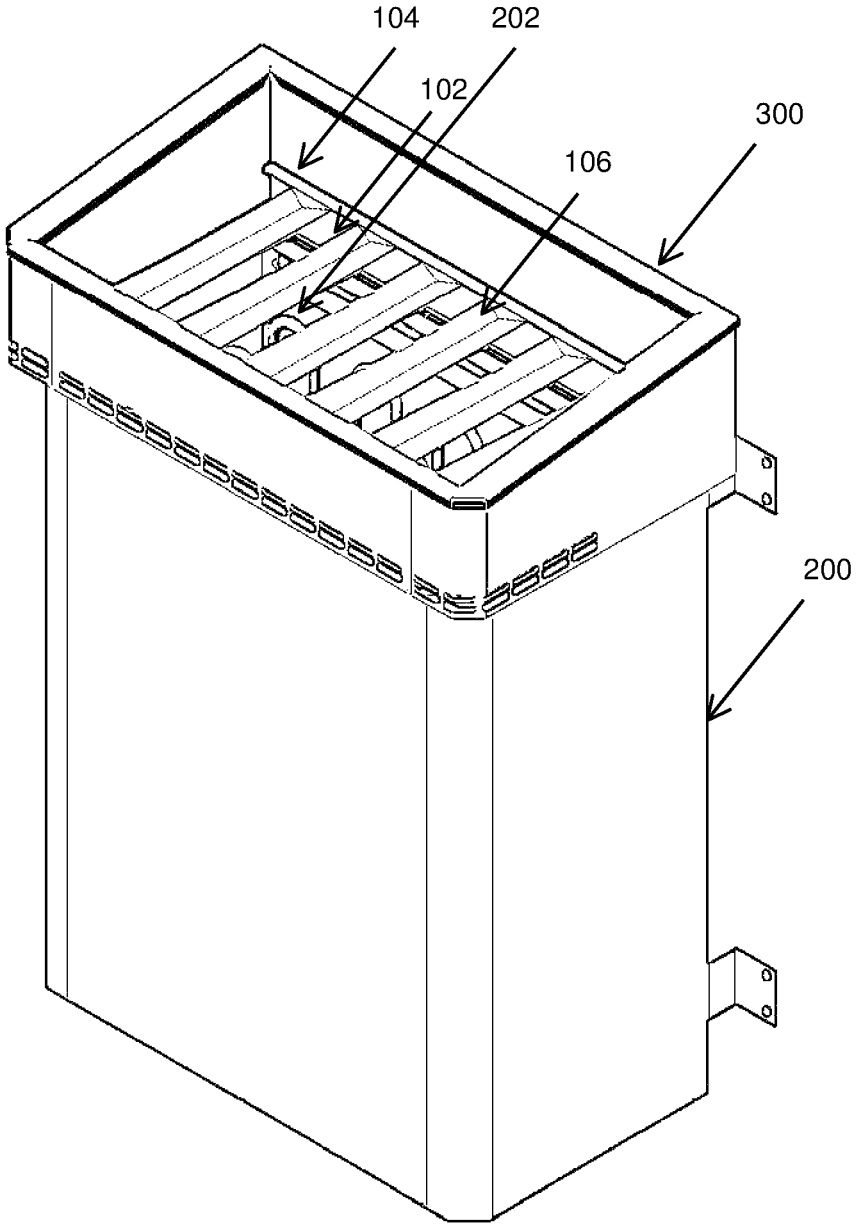
FIG. 3 shows a view of a sauna heater having the evaporator tray.

Referring now to FIG. 3, which shows a view of a sauna heater 200, evaporator trays 100 are contained within a housing 300, which helps support rocks 204 (not shown).

The invention has therefore the ability to maintain a very high evaporation rate for a long time during operation, offering the following advantages:

increasing the capacity of an electric sauna heater to create steam thereby quickly raising the apparent heat in the sauna cabin;

protecting the electrical heating elements from the corrosive effects of contact with the sauna rocks;

protecting the sauna rocks from the damaging effects of the extreme heat which would occur if the rocks were in direct contact with the heating elements; and providing protection thereby preventing users from placing their hands directly on the heating elements.

The invention provides an important benefit to the enjoyment of a sauna experience with electrical sauna heaters.

Evaporation occurs directly below the rocks and if there is excess water it is ejected outside the heater shell. It is impossible for the evaporator tray to become cold because of their proximity to the heater elements. The running costs of current designs are increased by the short life span of both the rocks and the elements. As these components deteriorate, water is not evaporated effectively and progressively more of the water that is poured onto the heater finds its way down to the electrical connections and other important parts of the heater, thereby shortening the lifespan of the heater housing and components.

INDUSTRIAL APPLICABILITY

The present invention prolongs the life of the heating elements and rocks while crucially giving excellent performance because it supports the rocks directly above the electrical heating elements and comprises vertically staggered supports providing both vertical and horizontal air passages through the rocks, which allows air to flow rapidly through the rocks.

The invention claimed is:

1. An evaporator tray for a sauna heater comprising:

a support member;

two or more elongate plate members extending across said support member, said plate members comprising a concave cross-section;

in which said plate members form two layers extending across said support member, each layer comprising two or more plate members, one layer arranged above the other in use and in which said layers are horizontally staggered to allow passage of hot air from a heating element located in said sauna heater;

wherein, in use, said plate members support rocks and collect unevaporated water thereby protecting the sauna heater.

2. An evaporator tray according to claim 1, in which said generally concave cross-section includes a cross-section which is "V"-shaped, "U"-shaped, arcuate, concave, or other shape suitable for collecting water.

3. An evaporator tray according to claim 1 comprising a housing for retaining said rocks.

4. A sauna heater comprising the evaporator tray of claim 3.

* * * * *